US009920893B2

(12) United States Patent
Huang et al.

(10) Patent No.: US 9,920,893 B2
(45) Date of Patent: Mar. 20, 2018

(54) BUSLINE LED MODULE

(71) Applicant: General LED, Inc., San Antonio, TX (US)

(72) Inventors: Michelle Kun Huang, San Antonio, TX (US); Gray Lankford, San Antonio, TX (US)

(73) Assignee: General LED Opco, LLC, San Antonio, TX (US)

( * ) Notice: Subject to any disclaimer, the term of this patent is extended or adjusted under 35 U.S.C. 154(b) by 406 days.

(21) Appl. No.: 14/743,420

(22) Filed: Jun. 18, 2015

(65) Prior Publication Data

US 2015/0369459 A1 Dec. 24, 2015

Related U.S. Application Data

(60) Provisional application No. 62/013,791, filed on Jun. 18, 2014.

(51) Int. Cl.

| | |
|---|---|
| ***F21V 5/04*** | (2006.01) |
| ***G09F 13/22*** | (2006.01) |
| ***F21V 31/04*** | (2006.01) |
| ***F21S 4/10*** | (2016.01) |
| ***F21V 17/10*** | (2006.01) |
| ***F21V 21/002*** | (2006.01) |
| *F21Y 115/10* | (2016.01) |

(52) U.S. Cl.

CPC ..... *F21S 4/10* (2016.01); *F21V 17/101* (2013.01); *F21V 21/002* (2013.01); *F21Y 2115/10* (2016.08); *Y10T 29/49131* (2015.01)

(58) Field of Classification Search

CPC .... F21V 5/04; F21V 31/04; F21S 4/10; G09F 13/22

See application file for complete search history.

(56) References Cited

U.S. PATENT DOCUMENTS

| | | | |
|---|---|---|---|
| 4,380,613 | A | 4/1983 | Nativi |
| 6,534,723 | B1 | 3/2003 | Asai et al. |
| 2006/0292747 | A1 | 12/2006 | Loh |
| 2011/0089464 | A1 | 4/2011 | Lin et al. |
| 2011/0096551 | A1 | 4/2011 | Sekela et al. |
| 2013/0052848 | A1 | 2/2013 | Sloey et al. |
| 2014/0264427 | A1 | 9/2014 | Tischler |
| 2014/0268818 | A1 | 9/2014 | Huang et al. |
| 2015/0062889 | A1 | 3/2015 | Kika |

*Primary Examiner* — Joseph L Williams

(74) *Attorney, Agent, or Firm* — William H. Quirk; Jesse Frizzell; Rosenthal Pauerstein Sandoloski Agather LLP

(57) ABSTRACT

A bus line LED module includes a printed circuit board on which LEDs are mounted and lens portion formed over the LEDs. A pair of wires is positioned beneath the printed circuit board within a bottom portion assembly to form a top portion assembly. A pair of windows within a bottom portion assembly enables access to a portion of the wires where a metal-to-metal contact to the metal inner portion of the wires is made. A pair of metal connectors extends from the printed circuit board to make metal-to-metal contact with the metal wires. A sealing connection is made between the top portion assembly and the bottom portion assembly.

19 Claims, 5 Drawing Sheets

BUSLINE LED MODULE

CROSS REFERENCE TO RELATED APPLICATION

This application claims the benefit of Provisional U.S. Patent Application No. 62/013,791 filed Jun. 18, 2014.

FIELD

The disclosed device pertains to a system and method for constructing and providing electrical energy to LED modules mounted on wires.

BACKGROUND

LED modules are typically supplied to users in LED strings wherein multiple LED modules are connected one to another by wires. Not only do the wires physically connect the LED modules one to another, but the wires provide either direct current or alternating current electrical energy to a printed circuit board within each LED module on which one or more LEDs are mounted.

Since strings of LED modules are used in many different applications, the spacing of the LED modules along the wires often depends on the ultimate use of the string of LED modules. Accordingly, some users of strings of LED modules will order strings of LED modules specifying a predetermined distance between individual LED modules or groups of LED modules when the LED modules are mounted to the wires. And, because LED modules are typically individually manually attached to the wires, the manufacturer attaching the LED modules to the wires must individually measure the distance between the LED modules when mounting the LED modules to the wire to form a string of LED modules. Such measurement of the distance between LED modules is time consuming and prone to error.

Accordingly, there remains a need in the art to eliminate the time and errors associated with the process of manually attaching individual LED modules to the wires to create a string of LED modules.

SUMMARY

The disclosed device and method eliminates the time and errors associated with manually attaching LED modules individually to wires to form a string of LED modules.

The disclosed busline LED module includes a printed circuit board. Mounted on the top of the printed circuit board are one or more LEDs. Positioned over the LEDs is a lens portion.

Providing electrical energy to the printed circuit board is a pair of wires. Each of the wires in the pair of wires has an outer insulation portion and an inner metal portion.

The disclosed bus line LED module has a top portion assembly which includes the printed circuit board and a lens portion. The printed circuit board and the lens portion may be snap fit or press fit together. Electrically connected to the printed circuit board and extending outwardly from the bottom of the printed circuit board are a plurality of metal connectors.

Beneath the top portion assembly is a bottom portion assembly. The bottom portion assembly includes a passageway to position the wires. Within the bottom portion assembly are windows or openings in which the metal connectors are placed to properly position them for engagement with the inner metal portion of the wires when the wires are in the passageways.

When the top portion assembly of the busline LED module is placed over the bottom portion assembly of the busline LED module that portion of the metal connector which extends outwardly from the bottom of the printed circuit board passes through the windows or openings in the bottom portion assembly of the busline LED module and makes metal-to-metal contact with the inner metal portion of the insulated wires. In addition, the bottom of the lens portion in the top portion assembly makes contact with top of the bottom portion assembly of the busline LED module so that a sealing connection may be made between the bottom of the lens portion in the top portion assembly and the top of the bottom portion assembly of the busline LED module.

BRIEF DESCRIPTION OF THE DRAWING FIGURES

A better understanding of the disclosed busline LED module may be had by reference to the drawing figures, wherein.

DESCRIPTION OF THE EMBODIMENTS

Figure 1:
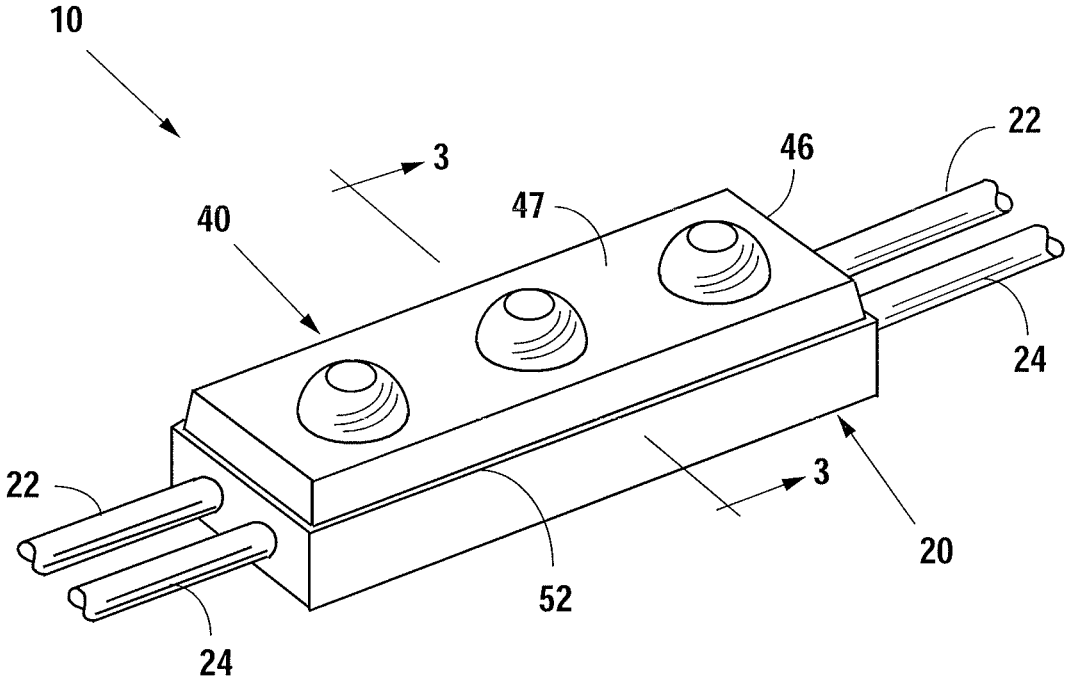
FIG. 1 is a perspective view of a first embodiment of the busline LED module.

As shown in FIG. 1, FIG. 2 and FIGS. 3A and 3B, the disclosed busline LED module 10 includes three pieces.

Within busline LED module 10 is a printed circuit board 42. Physically mounted to and electrically connected to the printed circuit board 42 are one or more LEDs 44. Included on the printed circuit board 42 are connections which enable the receipt of electrical energy which electrical energy passes through electrical componentry on the printed circuit board 42 to transform the electrical energy into a form that will enable the LEDs 44 to emit light energy.

Placed over the LEDs 44 is a lens portion 46. Each lens 45 within the lens portion 46 is positioned within a web 47 so that when the lens portion 46 is positioned over the printed circuit board 42, each individual lens 45 is positioned over each LED 44 thereby providing management of the light energy emitted from each LED 44. Alternatively, the lens portion 46 may be a flat translucent piece if management of the emission of light energy from each LED 44 is not required.

Figure 3A:
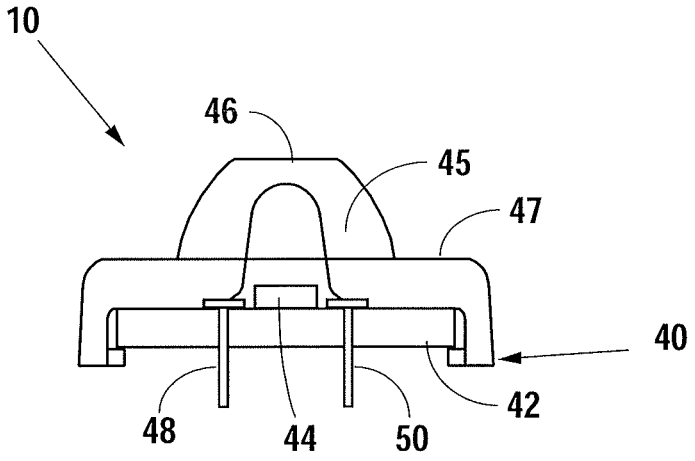
FIG. 3A is a partial sectional view showing the disclosed busline LED module without the bottom portion.

As shown in FIG. 3A, the printed circuit board 42 and the lens portion 46 form the top portion assembly 40 of the disclosed busline LED module 10.

Beneath the top portion assembly 40 of the water proof LED module 10 is the bottom portion assembly 20 of the busline LED module 10.

As indicated above the printed circuit board 42 includes connections which enable the receipt of electrical energy by the electrical componentry which electrical componentry transforms the electrical energy into a form usable by the LEDs. Such electrical connections may be on the top, the bottom, or within the printed circuit board 42. Wires 22, 24 conduct the electrical energy to the printed circuit board 42.

Figure 2:
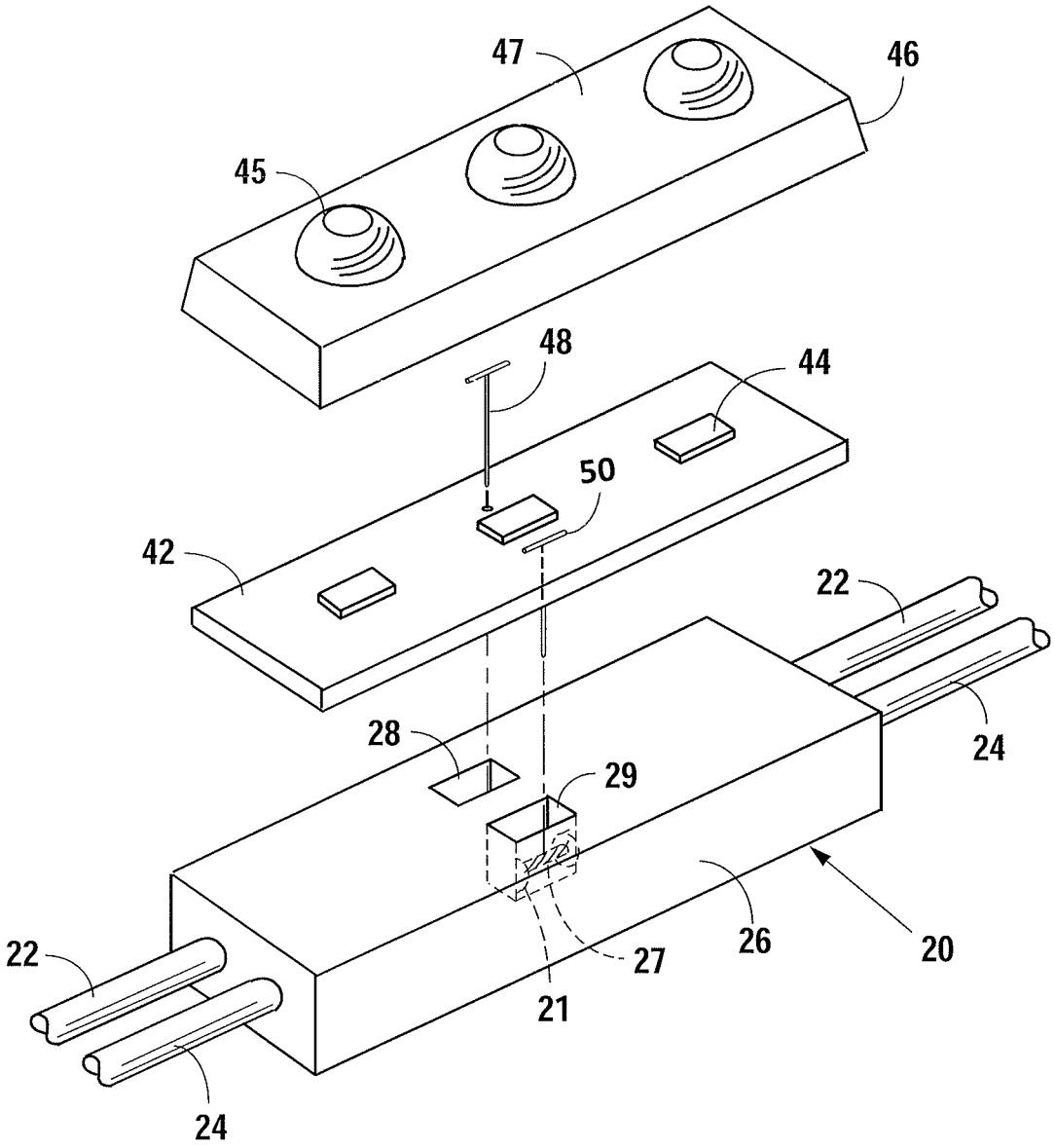
FIG. 2 is an exploded view of the busline LED module shown in FIG. 1.

In the first embodiment the bottom portion assembly 20 is a molded plastic block 26 which is formed around the wires 22, 24 at each place 21 on the wires 22, 24 where a section of the outer insulation portion has been removed to reveal the inner metal portion 27 of the wires 22, 2 . As shown in FIG. 2, within the molded plastic block 26 are two windows 28, 29. Each window 28, 29 provides access to the inner metal portion 27 of the wires 22, 24 molded within the molded plastic block 26 where the section of the outer insulation portion has been removed.

By use of the disclosed busline module 10 a variety of different printed circuit boards, LEDs, and lens portions may be used with one bottom portion assembly 20.

Figure 3B:
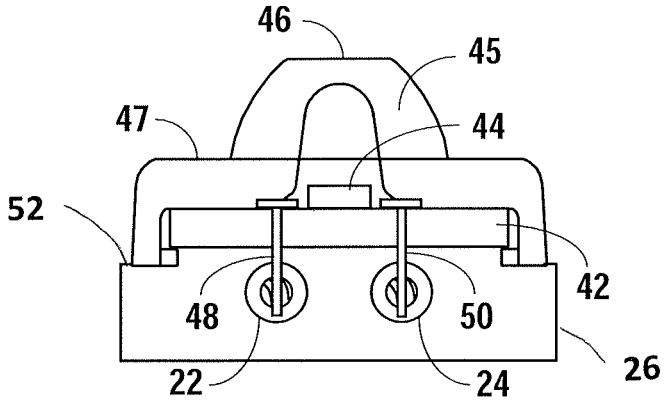
FIG. 3B is a sectional view at line 3-3 of FIG. 1 showing the disclosed busline LED module with the bottom portion.

An electrical connection is made between the inner metal portion 27 of the wires and the printed circuit board 42 by metal pin connectors 48, 50. A variety of styles of metal pin connectors to include T-shaped, L-shaped or straight metal pin connectors may be used. In the preferred embodiment, a T-shaped metal connector, as shown in FIG. 2, FIG. 3A and in FIG. 3B is used. The metal pin connectors 48, 50 are included in the top portion assembly 40.

An upper part of each metal pin connector 48, 50 is in electrical contact with that portion of the printed circuit board 42 which receives electrical energy by use of surface mount technology well known to those of ordinary skill in the art. The location of that portion of the printed circuit board 42 which receives electrical energy may be either on the top, the bottom or within the printed circuit board 42. The length of the metal pin connectors 48, 50 enables the metal pin connectors 48, 50 to extend through the windows 28, 29 in the block 26 in the bottom portion assembly 20 of the bus line LED module 10 and make metal-to-metal contact with the inner metal portion 27 of the wires 22, 24.

Once the bottom of the metal pin connectors 48, 50 makes metal-to-metal contact with the inner metal portion 27 within the wires 22, 24, the top portion assembly 40 and the bottom portion assembly 20 may pass through an infrared reflow oven to melt solder which can be used to connect the metal pin connectors 48, 50 to the inner metal portion 27 of the wires 22, 24.

The length of the metal pin connectors 48, 50 is such that when the bottom of the metal pin connectors 48, 50 engages the exposed inner metal portion 27 of the wires 22, 24, the bottom of the lens portion 46 makes physical contact with the top of the block 26 in the bottom portion assembly 120 which is molded around the wires 22, 24.

Once the lens portion 46 makes contact with the top of the molded block 26 a variety of sealing methods including vibration, sonic welding, heat staking, a compressed heat gasket, a compressed glue gasket, or a compressed chemical gasket may be used to make a sealing connection between the top of the molded block 26 and the bottom of the lens portion 46. Such sealing methods enable the formation of a sealing connection 52 between the bottom of the lens portion 46 and the top of the molded block 26.

Figure 4:
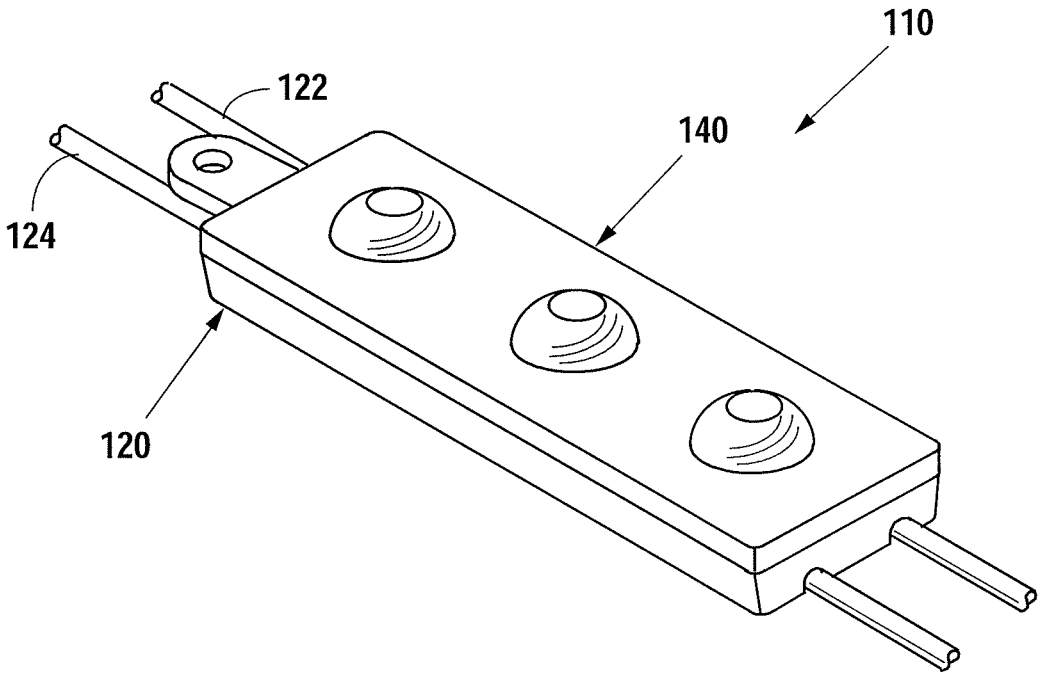
FIG. 4 is a perspective view of a second embodiment of the busline LED module.
Figure 5:
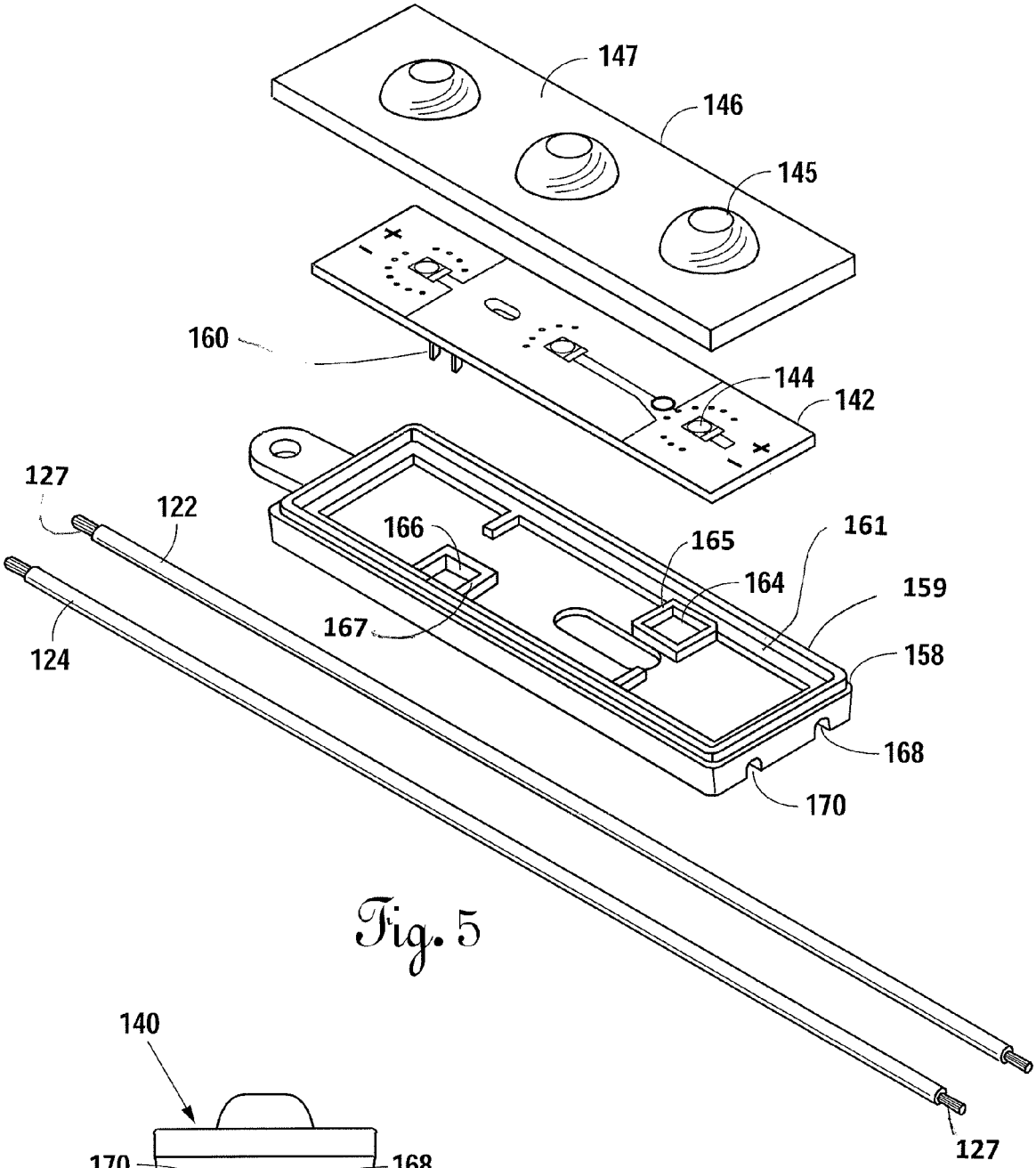
FIG. 5 is an exploded view of the second embodiment of the busline LED module shown in FIG. 4.
Figure 6:
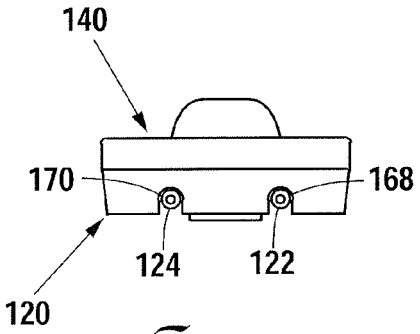
FIG. 6 is an end view of the busline module shown in FIG. 4.

The construction of the second embodiment illustrated in FIG. 4, FIG. 5 and FIG. 6 is similar to that of the first embodiment illustrated in FIG. 1, FIG. 2, FIG. 3A and FIG. 3B. Accordingly, the reference numbers used in FIG. 4, FIG. 5 and FIG. 6 are similar to the reference numbers used in FIG. 1, FIG. 2, FIG. 3A and FIG. 3B but for the numeral "1" in the hundreds place.

Within the busline LED module 110 shown in FIG. 4, FIG. 5 and FIG. 6 is a printed circuit board 142. Physically mounted to and electrically connected to the printed circuit board 142 are one or more LEDs 144 as shown in FIG. 5. Included on the printed circuit board 142 are connections which enable the receipt of electrical energy which passes through electrical componentry on the printed circuit board 142 to the LEDs 144. The LEDs 144 transform the electrical energy into light energy.

Placed over the LEDs 144 is a lens portion. Each lens within the lens portion 146 is positioned within a web 147 so that when the lens portion 146 is positioned over the printed circuit board 142 each individual lens 145 is positioned over each individual LED 144 thereby enabling management of the light output from each LED 144. Alternatively, the lens portion may be a flat translucent piece if management of the light output from each LED 144 is not required.

As shown in FIG. 5 and in FIG. 6, the printed circuit board 142 and the lens portion 146 form the top portion assembly 140 of the disclosed busline LED module 110.

Beneath the top portion assembly 140 of the busline LED module 110 is the bottom portion assembly 120 of the busline LED module 110.

As indicated above, the printed circuit board 142 includes connections which enable the receipt of electrical energy. Such connections may be on the top, the bottom, or within the printed circuit board 142. Wires 122, 124 conduct the electrical energy to the printed circuit board 142.

Extending below the printed circuit board 142 is a pair of insulation displacement connection connectors 160. The insulation displacement connection connectors 160 extend through openings 164, 166 in the printed circuit board support piece 158 in the bottom portion assembly 120 and into open channels 168, 170.

Surrounding the top of the printed circuit board support piece 158 is a locating rim 159 which fits within the lens portion 146. Adjacent to the locating rime 159 is a platform 161 on which the outer portion of the printed circuit board 142 rests. Surrounding each opening 164, 166 are sealing surfaces 165, 167 which contact the bottom of the printed circuit board 142.

Thus, when the wires 122, 124 are in the open channels 168, 170 the insulation displacement connection connectors 160 may be pushed into engagement with the wires 122, 124. The sharpened inside edge of the leg portions of the insulation displacement connection connectors 160 cut through the outer insulation portion thereby enabling metal-to-metal contact between the inside edge of the leg portion of the insulation displacement connection connectors 160 and the inner metal portion 127 of the wires 122, 124.

As with the first embodiment, the use of the second embodiment of the disclosed busline module 110 enables the use of a variety of different printed circuit boards, LEDs, and lens portions with a single bottom portion assembly 120.

The top of each insulation displacement connection connector 160 is in electrical contact with that portion of the printed circuit board 142 with receives electrical energy from the insulation displacement connection connector 160 by the use of surface mount technology as is well known to those of ordinary skill in the art. The location of that portion of the printed circuit board 142 which receives electrical energy may be on the top, the bottom or within the printed circuit board 142.

The length of the leg portions of the insulation displacement connection connectors 160 enable the leg portions of the insulation displacement connection connectors 160 to extend through the openings 164, 166 in the printed circuit bottom support piece 158 in the bottom portion assembly 120, cut through the outer insulation portion of the wires 122, 124 and make metal-to-metal contact with the inner metal portion 127 of the wires 122, 124 when the combination of the printed circuit board 142 and the lens portion 146 is placed on the printed circuit board support piece 158 of the bottom portion assembly 120.

Once the bottom of the lens portion 146 makes contact with printed circuit board support piece 146 a variety of sealing methods may be used to include vibration, sonic welding, heat staking, a compressed heat gasket, a compressed glue gasket, or a compressed chemical gasket.

In addition sealing contact is made between the sealing surfaces 165, 167 around the openings 164, 166 in the printed circuit board support piece 158 and the bottom of the printed circuit board 142.

Accordingly, what has been disclosed herein is a busline LED module including a printed circuit board, said printed circuit board having LEDs mounted on the top thereof and a lens portion positioned over the LEDs on the printed circuit board, said busline LED module comprising: a pair of wires having an insulated outer portion and a metal inner portion for conducting electrical energy to the printed circuit board, each of said wires in said pair of wires having a section of the insulated outer portion removed to expose the metal inner portion therein; a bottom portion assembly including: a block molded over said insulated outer portion of said pair of wires, said block including windows formed there to provide access to the exposed metal portion of the insulated wires; a top portion assembly including: the printed circuit portion and the lens portion; a pair of metal pin connectors connected to the top of the printed circuit board and extending outwardly from the bottom of the printed circuit board; whereby when said top portion assembly is placed on said bottom portion assembly, said pair of metal pin connectors will pass through said windows in said block and make metal-to-metal contact with said exposed portion of the insulated wires and the lens portion will contact the top of said to block to enable the forming of a sealing connection between said top portion assembly and said bottom portion assembly.

In an alternate embodiment of the disclosed busline LED module, insulation displacement connection connectors may be used instead of metal pin connectors.

While those of ordinary skill in the art will understand that various different sequences of steps may be used to construct the water proof bus line LED module 10 of the present invention, the following description of steps enables the construction of the disclosed water proof bus line LED module 10.

The first step is exposing the metal portion 27 of the insulated wires 22, 24 by cutting away a portion of the insulation at predetermined intervals.

Once the metal portion 27 of the wires 22, 24 has been exposed, a block 26 is formed over the insulated wires 22, 24. The block 26 includes a pair of windows 28, 29 which provide access to the metal portion 27 of the wires 22, 24 at predetermined intervals.

The top portion assembly of the bus line LED module 10 is then formed. The printed circuited board 42 is then snap fit or press fit into the lens portion 46. The combination of the printed circuit board 42 with the metal pin connectors 48, 50 extending therefrom and the lens portion 46 are then positioned so that the metal pin connectors 48, 50 extend into the windows 28, 29 in the block 26 portion of the bottom portion assembly 20 so that the bottom of the metal pin connectors 48, 50 engage the metal portion 27 of the insulated wires 22, 24 which metal portions 27 have been exposed at predetermined intervals.

When the bottom of the metal pin connectors 48, 50 have engaged the metal portion 27 of the insulated wires 22, 24 the bottom of the lens portion 46 will physically touch the top of the block 26. At the intersection of the lens portion 46 and the top of the block 26 the lens portion 46 and the top of the block 26 are connected one to another to create a sealing connection 52.

Accordingly, what has been disclosed herein is a method of connecting a printed circuit board with LEDs mounted thereon and a lens portion positioned over the LEDs to a pair of wires, said method comprising: exposing a portion of the metal inner portion of the wires within each pair of insulated wires; forming a block over said pair of insulated wires, said block having windows formed therein to provide access to the exposed portion of the said metal wires within each of said wires; forming a top portion assembly using the printed circuit board and the lens portion and further including a pair of metal pin connectors extending outwardly from the bottom of the printed circuit board; connecting said top portion assembly to said block so that said metal pin connectors pass through said windows in said block and make metal-to-metal contact with the exposed portion of said wires thereby enabling physical contact between the bottom of the lens portion and the top of said block so that a sealing connection can be made therebetween.

In an alternate method for making the disclosed busline LED module, insulation displacement connectors may be used instead of metal pin connectors.

While the foregoing device and method have been disclosed according to their preferred embodiment, those of ordinary skill in the art will realize that other embodiments will become known to those of ordinary skill in the art after having read the foregoing paragraphs. Such other embodiments shall be included within the scope and meaning of the appended claims.

What is claimed is:

1. A bus line LED module including a printed circuit board, said printed circuit board having LEDs mounted on the top thereof and a lens portion positioned over the LEDs on the printed circuit board, said bus line module comprising:

a pair of wires having an insulated outer portion and a metal inner portion for conducting electrical energy to the printed circuit board, each of said wires in said pair of wires having a section of the insulated outer portion removed to expose the metal inner portion therein;

a bottom portion assembly including:

a block molded over said insulated outer portion of said pair of wires, said block including windows formed therein to provide access to said exposed metal inner portion within said wires;

a top portion assembly including:

the printed circuit board and the lens portion;

a pair of metal pin connectors electrically connected to the printed circuit board and extending outwardly from the bottom of the printed circuit board;

whereby when said top portion assembly is placed on said bottom portion assembly, said pair of metal pin connectors will pass through said windows in said block and make metal-to-metal contact with said exposed metal inner portion within said wires and the lens portion will contact the top of said block to enable the forming of a sealing connection between said top portion assembly and said bottom portion assembly.

2. The bus line LED module as defined in claim 1 wherein said sealing connection is a vibration connection.

3. The bus line LED module as defined in claim 1 wherein said sealing connection is a sonic weld connection.

4. The bus line LED module as defined in claim 1 wherein said sealing connection is a heat staking connection.

5. The bus line LED module as defined in claim 1 wherein said sealing connection is a compressed heat gasket.

6. The bus line LED module as defined in claim 1 wherein said sealing connection is a compressed glue gasket.

7. The bus line LED module as defined in claim 1 wherein said sealing connection is a compressed chemical gasket.

8. The bus line LED module as defined in claim 1 wherein said pin connector is a T-shaped pin.

9. The bus line LED module as defined in claim 1 wherein said pin connector is an L-shaped pin.

10. A bus line LED module including a printed circuit board, said printed circuit board having LEDs mounted on the top thereof and a lens portion positioned over the LEDs on the printed circuit board, said bus line LED module comprising:

a pair of wires having an insulated outer portion and a metal inner portion for conducting electrical energy to the printed circuit board;

a bottom portion assembly including:

a printed circuit board support having a pair of channels formed in the bottom thereof and a pair of openings formed therethrough;

a top portion assembly including:

the printed circuit board and the lens portion;

a pair of insulation displacement connection connectors electrically connected to the printed circuit board and extending outwardly from the bottom of the printed circuit board;

whereby when said top portion assembly is placed on said bottom portion assembly, said pair of insulation displacement connection connectors will pass through said pair of openings formed in said printed circuit board support, displace the insulation in the insulated outer portion of the wires and make metal-to-metal contact with said metal inner portion of the wires, and the lens portion will contact the top of said printed circuit board support to enable the forming of a sealing connection between said top portion assembly and said bottom portion assembly, and a sealing connection around said openings in said printed circuit board support when said wires are within said channels on the bottom of said printed circuit board support.

11. The bus line LED module as defined in claim 10 wherein said sealing connections are vibration connections.

12. The bus line LED module as defined in claim 10 wherein said sealing connections are sonic weld connections.

13. The bus line LED module as defined in claim 10 wherein said sealing connections are heat staking connections.

14. The bus line LED module as defined in claim 10 wherein said sealing connections are compressed heat gaskets.

15. The bus line LED module as defined in claim 10 wherein said sealing connections are compressed glue gaskets.

16. The bus line LED module as defined in claim 10 wherein said sealing connections are compressed chemical gaskets.

17. The bus line LED module as defined in claim 10 wherein:

said sealing connection between said top portion assembly and said bottom portion assembly is selected from a group including a vibration connection, a sonic weld connection, a heat staking connection, a compressed heat gasket, a compressed glue gasket, and a compressed chemical gasket; and said sealing connection around said openings in said printed circuit board support when said wires are in said channels on the bottom of said printed circuit board support is selected from a group including a vibration connection, a sonic weld connection, a heat staking connection, a compressed heat gasket, a compressed glue gasket, and a compressed chemical gasket.

18. A method of connecting a printed circuit board with LEDs mounted thereon and a lens portion positioned over the LEDs on the printed circuit board to a pair of wires having an insulated outer portion and a metal inner portion, said method comprising:

exposing a section of the metal inner portion of the wires within each of said wires;

forming a block over said pair of wires, said block having windows formed therein to provide access to the exposed metal inner portion of the wires within each of said wires;

forming a top portion assembly using the printed circuit board and the lens portion and further including a pair of metal pin connectors electrically connected to and extending outwardly from the bottom of the printed circuit board; and connecting said top portion assembly to said block so that said metal pin connectors pass through said windows in said block and make metal-to-metal contact with said exposed section of the metal inner portion of said wires thereby enabling physical contact between the bottom of the lens portion and the top of said block so that a sealing connection can be made therebetween.

19. A method of connecting a printed circuit board with LEDs mounted thereon and a lens portion positioned over the LEDs on the printed circuit board to a pair of wires having an insulated outer portion and a metal inner portion, said method comprising:

forming a top portion assembly using the printed circuit board and the lens portion and further including a pair of insulation displacement connection connectors electrically connected to and extending outwardly from the bottom of the printed circuit board;

placing a printed circuit board support under said printed circuit board, said printed circuit board support having channels formed on the bottom thereof and openings formed to accommodate the passage of said insulation displacement connection connectors therethrough;

placing the wires within said channels formed on the bottom of the printed circuit board support;

causing said insulation displacement connection connectors to move through said insulated outer portion of said wires to make metal-to-metal to metal contact with the metal inner portion of the wires;

forming a seal between the lens portion and the printed circuit board support; and forming a seal around the openings formed to accommodate the passage of said insulation displacement connection connectors therethrough.

* * * * *